US010141691B2

(12) United States Patent
Noro et al.

(10) Patent No.: US 10,141,691 B2
(45) Date of Patent: Nov. 27, 2018

(54) CONNECTOR

(71) Applicants: SUMITOMO WIRING SYSTEMS, LTD., Yokkaichi-shi, Mie (JP); NISSAN MOTOR CO., LTD., Yokohama-shi, Kanagawa (JP)

(72) Inventors: Yutaka Noro, Yokkaichi (JP); Kazuaki Takeda, Yokkaichi (JP); Masahito Matsuura, Yokkaichi (JP); Ryo Sawada, Yokohama (JP)

(73) Assignees: Sumitomo Wiring Systems, Ltd. (JP); Nissan Motor Co., Ltd. (JP)

( * ) Notice: Subject to any disclaimer, the term of this patent is extended or adjusted under 35 U.S.C. 154(b) by 0 days.

(21) Appl. No.: 15/575,406

(22) PCT Filed: May 13, 2016

(86) PCT No.: PCT/JP2016/064231

§ 371 (c)(1),
(2) Date: Nov. 20, 2017

(87) PCT Pub. No.: WO2016/194579

PCT Pub. Date: Dec. 8, 2016

(65) Prior Publication Data

US 2018/0145456 A1 May 24, 2018

(30) Foreign Application Priority Data

May 29, 2015 (JP) ..... 2015-109566

(51) Int. Cl.
*H01R 12/70* (2011.01)
*H01R 12/72* (2011.01)
(Continued)

(52) U.S. Cl.
CPC ..... *H01R 13/64* (2013.01); *H01R 12/7064* (2013.01); *H01R 13/055* (2013.01);
(Continued)

(58) Field of Classification Search
CPC ..... H01R 12/7064; H01R 12/724; H01R 13/055; H01R 13/41; H01R 13/42;
(Continued)

(56) References Cited

U.S. PATENT DOCUMENTS 6,786,756 B2 * 9/2004 Mase ..... H01R 13/6272 439/271
7,563,996 B2 * 7/2009 Loeffelholz ..... H01R 13/7031 200/51 R
(Continued)

FOREIGN PATENT DOCUMENTS

JP 62-65778 4/1987
JP 1-132076 9/1989
(Continued)

OTHER PUBLICATIONS

International Search Report dated Jul. 19, 2016.

*Primary Examiner* — Edwin A. Leon
*Assistant Examiner* — Oscar Jimenez
(74) *Attorney, Agent, or Firm* — Gerald E. Hespos; Michael J. Porco; Matthew T. Hespos

(57) ABSTRACT

Provided is a connector in which terminal fittings and detection terminals can be formed at the same time.
A housing (10) is provided with terminal fittings (20A) and a pair of detection terminals (20B). The terminal fittings (20A) are connected to ends of signal lines (70A), and electrically come into contact with counterpart terminal fittings (90A) provided in a counterpart housing (80) when both of the housings (10, 80) are fitted together. The pair of detection terminals (20B) are mutually energized thereby to close a detection circuit when both of the housings (10, 80) are properly fitted together. The pair of detection terminals (20B) are mutually connected via a detection line (70B) and formed in the same shape as the terminal fittings (20A).

7 Claims, 9 Drawing Sheets

(51) Int. Cl.

| | |
|---|---|
| ***H01R 13/05*** | (2006.01) |
| ***H01R 13/41*** | (2006.01) |
| ***H01R 13/42*** | (2006.01) |
| ***H01R 13/639*** | (2006.01) |
| ***H01R 13/64*** | (2006.01) |
| ***H01R 13/74*** | (2006.01) |

(52) U.S. Cl.
CPC ..... *H01R 13/41* (2013.01); *H01R 13/42* (2013.01); *H01R 13/743* (2013.01); *H01R 12/724* (2013.01); *H01R 13/639* (2013.01)

(58) Field of Classification Search
CPC .. H01R 13/639; H01R 13/64; H01R 13/7031; H01R 13/7032; H01R 13/743
USPC ..... 439/188, 345
See application file for complete search history.

(56) References Cited

U.S. PATENT DOCUMENTS

| | | | | |
|---|---|---|---|---|
| 7,918,676 | B2 * | 4/2011 | Tonosaki ..... | H01R 13/7031 439/157 |
| 9,887,490 | B2 * | 2/2018 | Matsuura ..... | H01R 13/4362 |
| 2017/0302030 | A1 * | 10/2017 | Chiang ..... | H01R 13/6474 |
| 2018/0034217 | A1 * | 2/2018 | Sekino ..... | H01R 13/7032 |

FOREIGN PATENT DOCUMENTS

| | | |
|---|---|---|
| JP | 4-127982 | 11/1992 |
| JP | 2005-5126 | 1/2005 |
| JP | 2007-305473 | 11/2007 |
| JP | 2014-135196 | 7/2014 |

* cited by examiner

CONNECTOR

BACKGROUND

Field of the Invention

The present invention relates to a connector.

Description of the Related Art

Japanese Patent Application Publication No. 2014-135196 discloses a connector having a first housing and a second housing, which can be mutually fitted. The first housing is provided with first terminal fittings and first detection terminal. The second housing is provided with second terminal fittings and second detection terminals.

Each of the first terminal fittings has a box having a tubular shape, and a barrel having an open barrel shape continued to the rear of the box. The barrel is connected to the end of an electric wire by pressure bonding. Furthermore, the first detection terminal has a base portion having a plate shape, and right and left elastic contact pieces extending from the base portion to the front. On the other hand, each of the first terminal fittings and the second detection terminals has a tab having a pin shape (not referred to in Japanese Patent Application Publication No. 2014-135196). The tab of each of the second detection terminals is provided with a conductive portion and a resin portion, which are disposed so as to be aligned in the front-back direction.

In the fitting process of the first housing and the second housing, the conductive portions of the second detection terminals elastically come into contact with the corresponding elastic contact pieces of the first detection terminal so that a detection circuit is closed. When the first housing and the second housing are properly fitted together, the elastic contact pieces move to ride onto the resin portions of the second detection terminals so that the detection circuit is opened. Therefore, with the opened state of the detection circuit, it is possible to electrically detect that the first housing and the second housing are properly fitted together. It is to be noted that contrary to Japanese Patent Application Publication No. 2014-135196, there is a case where the detection circuit is closed when the first housing and the second housing are properly fitted together, or rather, such a case occurs more often. When the first housing and the second housing are properly fitted together, the tabs of the second terminal fittings are inserted and connected into the boxes of the first terminal fittings, and the first terminal fittings and the second terminal fittings are conductively connected properly.

In the above case, the first detection terminal is formed in a shape different from the first terminal fittings. Consequently, the process for forming the first detection terminal is necessary aside from the process for forming the first terminal fittings. This may increase the number of processes and increase the cost.

The present invention has been completed based on the above circumstances, and an object of the present invention is to provide a connector in which terminal fittings and detection terminals can be formed at the same time.

SUMMARY

The present invention has a housing capable of being fitted to a counterpart housing, one or more terminal fittings provided in the housing, connected to ends of electric wires, and configured to electrically come into contact with counterpart terminal fittings provided in the counterpart housing when both of the housings are fitted together, and a pair of detection terminals provided in the housing and mutually energized thereby to form a detection circuit when both of the housings are properly fitted together. The pair of detection terminals are mutually connected via an electric wire and formed in the same shape as the terminal fittings.

Since the pair of detection terminals connected via the electric wire are formed in the same shape as the terminal fittings, the detection terminals can be formed at the same time in the forming process of the terminal fittings. As a result, the number of processes and the die cost can be reduced.

The electric wire connected to the pair of detection terminals is bundled together with the electric wires connected to the terminal fittings by a bundling member.

The electric wire connected to the pair of detection terminals has a substantially looped shape (U-shape or annular shape). Consequently, if the electric wire having a looped shape is spread, the space efficiency could be worsened. However, according to the above configuration, the electric wire having a looped shape and the electric wires connected to the terminal fittings are bundled by the bundling member thereby to be held together compactly and efficiently.

The housing is provided with a plurality of cavities into which the terminal fittings and the detection terminals are each inserted, a front wall closing a space on a front side of the cavities in an insertion direction of the terminal fittings and the detection terminals, and a retainer mounting hole intersecting and communicating with the cavities. A retainer to retain the terminal fittings and the detection terminals is inserted into the retainer mounting hole. A pressing portion protrudes on the retainer and is configured and disposed to abut onto the detection terminals and to press the detection terminals toward the front wall.

If the detection terminals move freely in the cavities, the detection timing will not be constant, so that the detection reliability could be deteriorated. In that respect, according to the above configuration, the detection terminals are capable of being pressed by the pressing portion in the cavities, so that the clearance between the retainer and the detection terminals is reduced or rendered absent. Thus, the detection terminals do not move freely in the cavities greatly, so that the detection reliability can be improved.

The pressing portion is not provided at a position corresponding to the terminal fittings.

Since it is not necessary to strictly prevent the terminal fittings not having a detection function from moving freely in the cavities as compared with the detection terminals, the pressing portion is not provided at the position corresponding to the terminal fittings. This can simplify the configuration of the retainer. Furthermore, the pressing portion is thus provided in the minimum necessary range, so that the sliding resistance caused between the retainer and the housing can be rendered small when the retainer is inserted into the retainer mounting hole. As a result, worsening of mounting operability of the retainer can be avoided.

The retainer is provided with a stopper configured to abut onto the housing when the retainer is properly inserted into the housing, the stopper and the pressing portion mutually protrude in the same direction, and a protruding end of the pressing portion is located behind a protruding end of the stopper. With this configuration, the pressing portion can be protected from foreign substances by the stopper, with the result that the pressing portion can be prevented from being damaged due to the interference with the foreign substances.

The counterpart housing is provided with counterpart detection terminals electrically connected to the detection circuit, the counterpart detection terminals and the counterpart terminal fittings are male terminals having respective tabs, the detection terminals and the terminal fittings are female terminals having respective main bodies into which the tabs are each inserted and connected, and the tabs of the counterpart detection terminals are shorter than the tabs of the counterpart terminal fittings.

The timing at which the tabs of the counterpart detection terminals are inserted and connected into the main bodies can be later than the timing at which the tabs of the counterpart terminal fittings are inserted and connected into the main bodies. This can prevent erroneous fitting detection before the counterpart terminal fittings are electrically connected to the terminal fittings.

DETAILED DESCRIPTION

Figure 1:
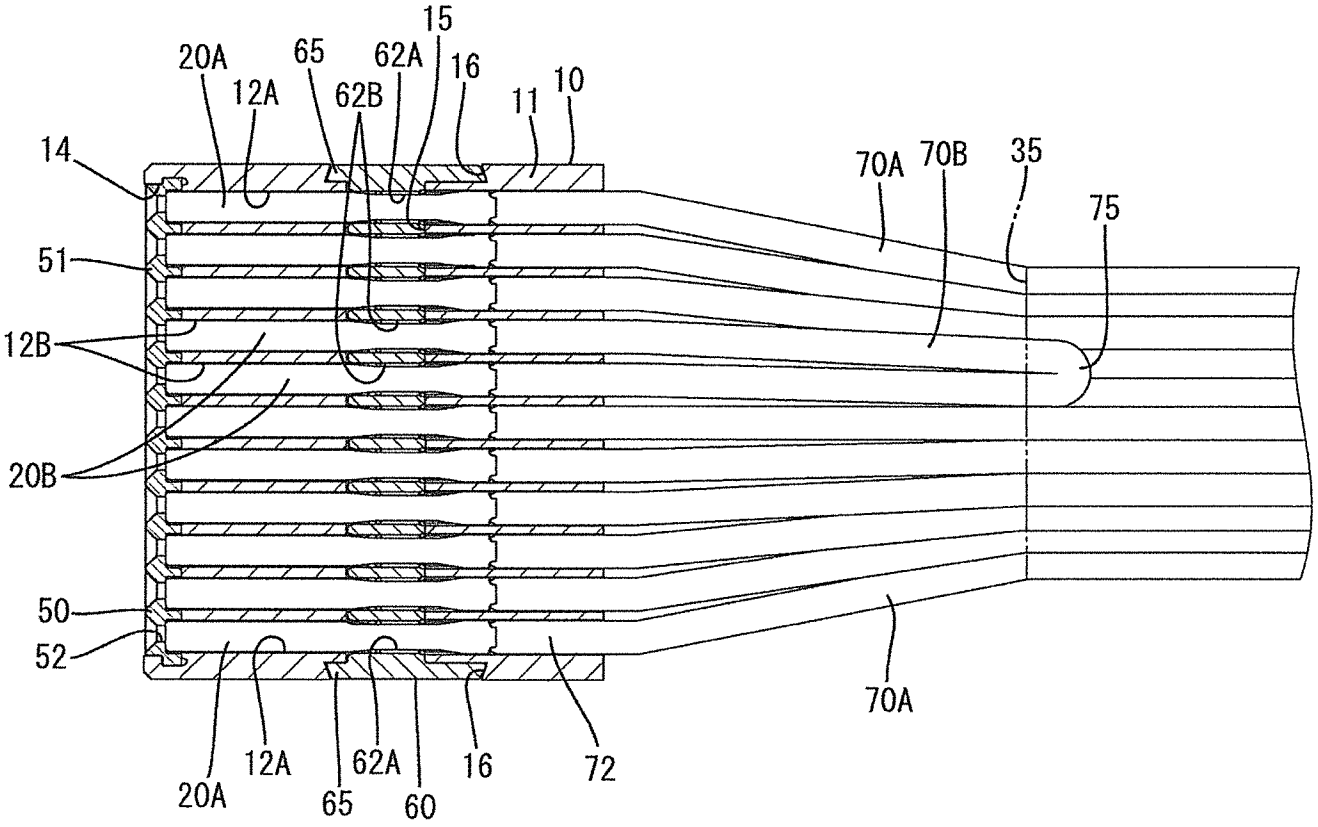
FIG. 1 is a diagram of a connector according to an example of the present invention, in a state where a detection line having a looped shape and signal lines therearound are bundled by a bundling member, seen in a plan view.

Hereinafter, an example of the present invention will be described with reference to FIGS. 1 to 9. A connector of the example has a housing 10, a plurality of terminal fittings 20A accommodated in the housing 10, a pair of detection terminals 20B also accommodated in the housing 10, and a retainer 60 assembled into the housing 10. The housing 10 can be fitted to a counterpart housing 80. In the following description, regarding the front-back direction, the side in which both of the housings 10 and 80 face each other at the time of the start of fitting is referred to as a front side. Furthermore, the up-down direction is based on FIGS. 3 to 6, 8, and 9.

The counterpart housing 80 is made of synthetic resin. As illustrated in FIG. 2(A), the counterpart housing 80 has a hood 81 having a square cylindrical shape and opened to the front. At the substantially central part of the inner face of the upper wall of the hood 81A, a cam follower 82 having a columnar shape is protrudingly provided. A plurality of counterpart terminal fittings 90A are attached in the counterpart housing 80.

The counterpart terminal fittings 90A are made of conductive metal. As illustrated in FIG. 2(A), the counterpart terminal fittings 90A have tabs 91A having a pin shape as a whole and extending in the front-back direction. The tabs 91A penetrate through a back wall 82 of the hood 81, and have respective distal ends disposed so as to protrude into the hood 81. The tabs 91A are disposed in the hood 81 so as to be aligned at predetermined intervals in the up-down direction and the left-right direction.

Furthermore, as illustrated in FIG. 2(A), a pair of counterpart detection terminals 90B are attached in the counterpart housing 80. The counterpart detection terminals 90B are electrically connected to a detection circuit, not illustrated. The counterpart detection terminals 90B are formed in the same shape as the counterpart terminal fittings 90A except for size (length), and have tabs 91B having a pin shape and protruding into the hood 81. In the hood 81, the tabs 91B of both counterpart detection terminals 90B are disposed side by side and adjacent to each other. More specifically, the tabs 91B of both counterpart detection terminals 90B are disposed at the same height position as the counterpart terminal fittings 90A in the upper row so as to be sandwiched between the counterpart terminal fittings 90A.

As illustrated in FIG. 2(A), the tabs 91B of the counterpart detection terminals 90B are formed as a whole to be shorter than the tabs 91A of the counterpart terminal fittings 90A. The tabs 91B of the counterpart detection terminals 90B have a smaller amount of protrusion into the hood 81 than the tabs 91A of the counterpart terminal fittings 90A. Thus, in the hood 81, the distal ends of the tabs 91B of the counterpart detection terminals 90B are disposed behind the distal ends of the tabs 91A of the counterpart terminal fittings 90A.

Figure 3:
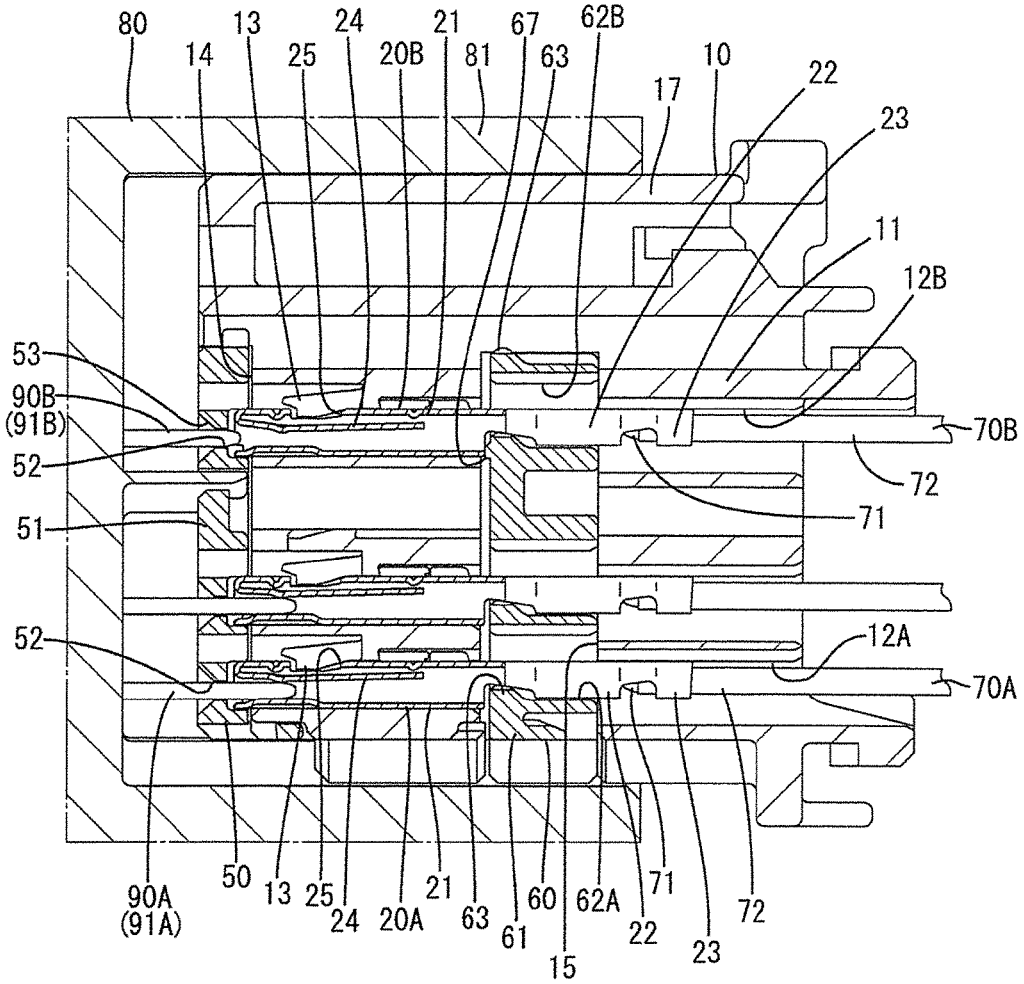
FIG. 3 is a diagram of a state where tabs are being inserted into main bodies at the final stage in which a housing is fitted to the counterpart housing, seen in side view.

The housing 10 is made of synthetic resin. As illustrated in FIGS. 1 and 3, the housing 10 has a housing body 11 having a square block shape as a whole. A plurality of cavities 12A and 12B are provided in the housing body 11 so as to extend in the front-back direction. The cavities 12A and 12B are disposed at the positions corresponding to the tabs 91A and 91B respectively, so as to be aligned in the up-down direction and the left-right direction. The cavities 12A and 12B are formed in the mutually same shape. As illustrated in FIG. 3, on the upper faces of the inner walls of the cavities 12A and 12B, lances 13 having a cantilevered shape and protruding frontward are provided respectively so as to be flexible. The terminal fittings 20A are inserted from the rear into the cavities 12A, among the cavities 12A and 12B, except for a pair of cavities 12B which will be described later.

Each of the terminal fittings 20A is integrally formed by the bending process of conductive metal plates and the like. As illustrated in FIG. 3, the terminal fitting 20A has a main body 21 having a square tubular shape and elongated in the front-back direction, a wire barrel 22 continued to the rear of the main body 21, and an insulation barrel 23 continued to the rear of the wire barrel 22. Inside the main body 21A, an elastic contact piece 24 having a cantilevered shape and extending so as to be folded back rearward from the front end of the upper wall of the main body 21 is provided so as to be flexible.

In the upper wall of the main body 21A, a lance hole 25 is provided so as to penetrate therethrough. When the terminal fitting 20A is properly inserted into the cavity 12A, the lance 13 is elastically engaged into the lance hole 25 in the main body 21 so that the terminal fitting 20A is primarily retained in the cavity 12A.

The wire barrel 22 has an open barrel shape, and is connected by pressure bonding to a core wire 71 exposed by the removal of coating 72 at the terminal of an electric wire for signal (hereinafter, called a signal line 70A). Furthermore, the insulation barrel 23 is connected by pressure bonding to the coating 72 at the terminal of the signal line 70A.

As illustrated in FIGS. 1 and 3, the detection terminals 20B are inserted from the rear into the pair of cavities 12B disposed side by side and adjacent to each other at the position near the center among the cavities 12A and 12B in the upper row.

As the detection terminals 20B, the terminal fittings 20A are also used. As illustrated in FIG. 3, the detection terminals 20B are formed in the same shape (the same shape and the same size) as the terminal fittings 20A. Each of the detection terminals 20B has the main body 21 provided with the lance hole 25 and the elastic contact piece 24, the wire barrel 22, and the insulation barrel 23. The detailed configurations of the detection terminals 20B are indicated by the same reference signs as the terminal fittings 20A.

The wire barrels 22 and the insulation barrels 23 are connected by pressure bonding to the terminal of an electric wire for detection (hereinafter, called a detection line 70B) which detects the fitting of both of the housings 10 and 80.

The detection line 70B has the same configuration as the signal lines 70A, although having a different use.

Figure 2:
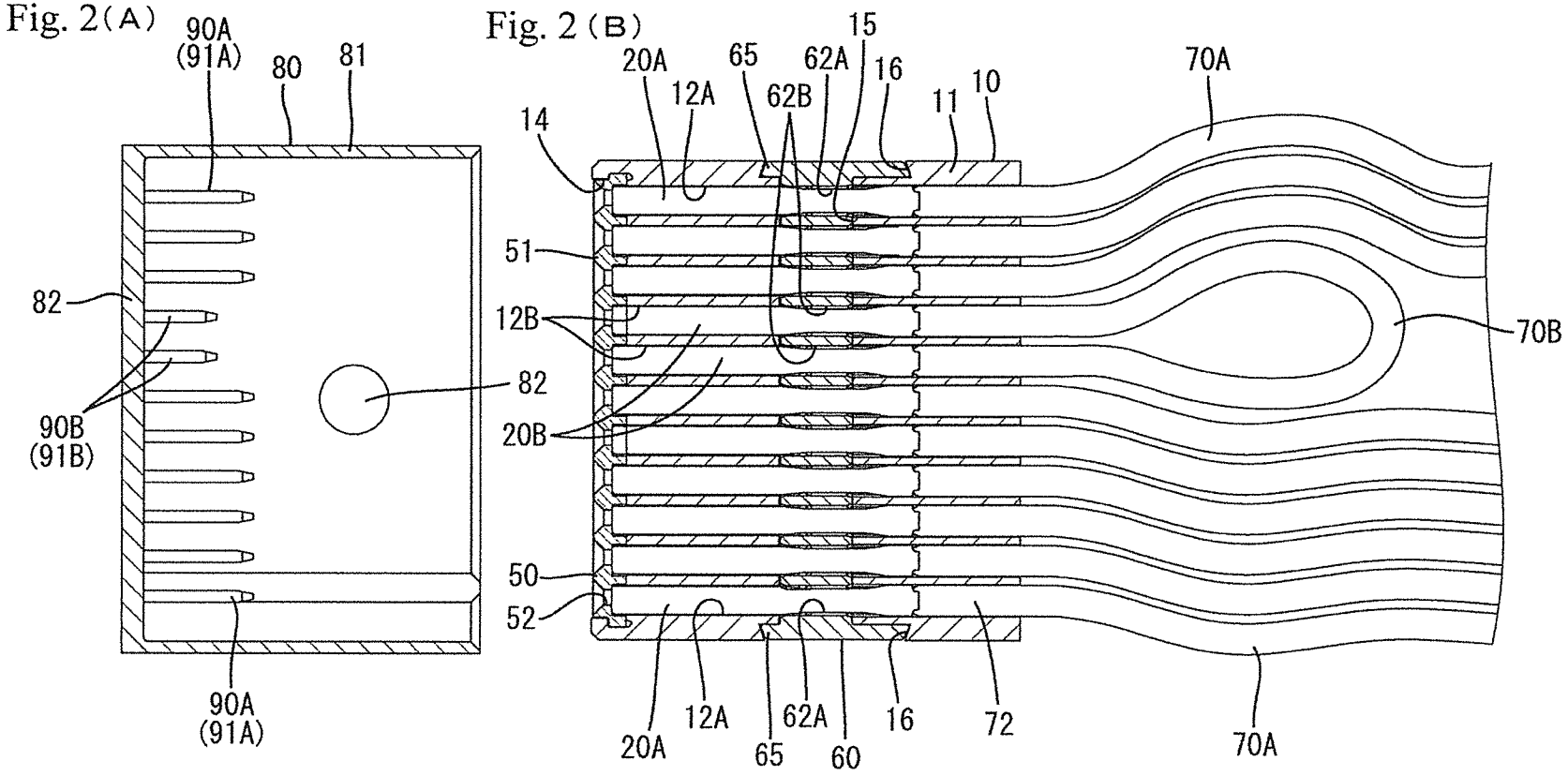
FIG. 2(A) is a diagram of the interior of a counterpart housing, seen in a plan view.
FIG. 2(B) is a diagram of a state before the detection line having a looped shape and the signal lines therearound are bundled by the bundling member, seen in a plan view.

As illustrated in FIG. 2, the wire barrels 22 and the insulation barrels 23 of the detection terminals 20B are connected to both lengthwise ends of the detection line 70B, and the main bodies 21 of both detection terminals 20B are directed to the front and are disposed in parallel, so that the detection line 70B is turned and bent in a looped shape (U-shape or annular shape). Thus, both detection terminals 20B are coupled together so as to be capable of being energized via one detection line 70B having a looped shape.

Figure 6:
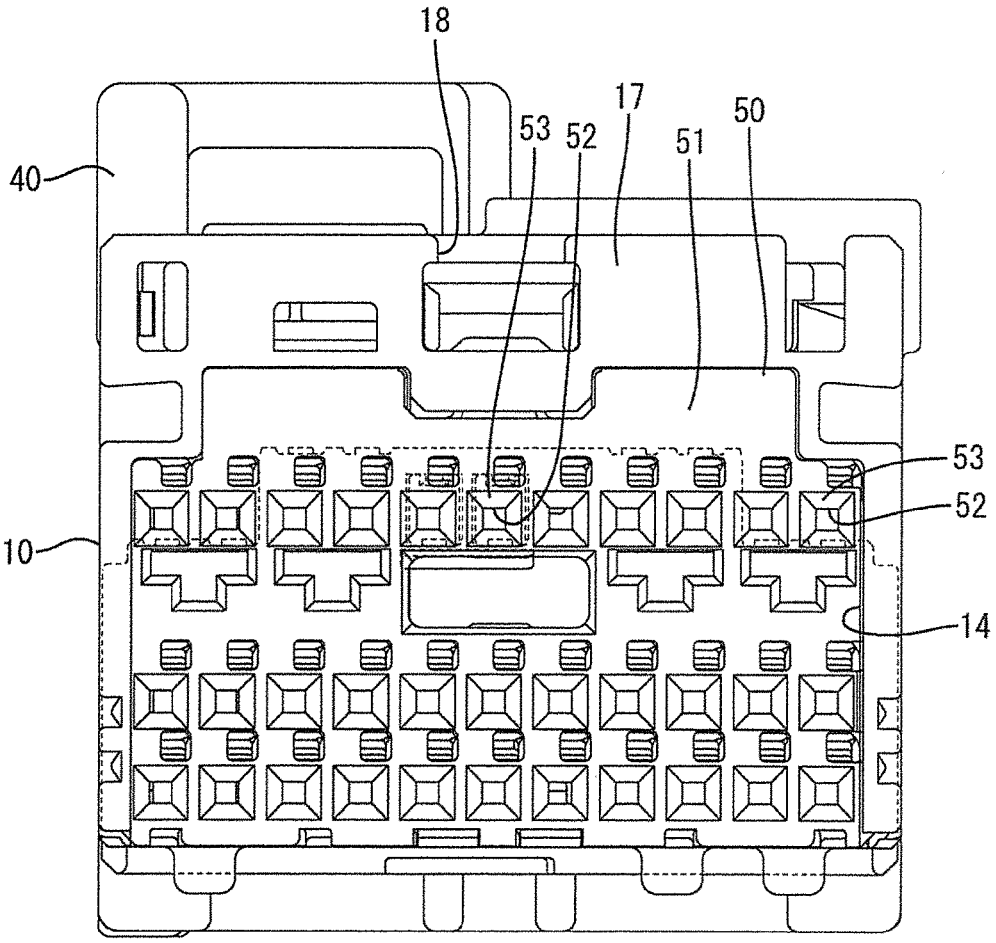
FIG. 6 is a front view of the housing.

As illustrated in FIG. 6, the front face of the housing body 11 has a portion having a gate shape from the upper end to both left and right sides, and a fitting recess 14 is provided inside the portion so as to be stepped down by one step. A front holder 50 separate from the housing body 11 is fitted into the fitting recess 14. The front holder 50 has a plate shaped front wall 51 which covers the front face of the housing body 11 (in detail, the inner face of the fitting recess 14). In the front wall 51A, a plurality of tab insertion holes 52 are provided so as to penetrate therethrough at the positions corresponding to the cavities 12A and 12B. The tab insertion holes 52 have a regular square shape in cross section, seen from the front, and are formed in the mutually same shape. As illustrated in FIGS. 2 and 3, a space in front of the cavities 12A and 12B is closed by a portion of the front wall 51 except for the tab insertion holes 52, at the front end of the housing 10.

As illustrated in FIGS. 3 and 6, on the front face of the front wall 51, guiding portions 53 having a tapered shape and enlarged to the front are provided at the opening edges of the tab insertion holes 52. The tabs 91A and 91B are guided into the guiding portions 53, and are inserted from the tab insertion holes 52 into the cavities 12A and 12B, respectively. Furthermore, as illustrated in FIGS. 1 and 3, the rear portions of the tab insertion holes 52 have substantially the same opening diameter as the cavities 12A and 12B, and communicate with the cavities 12A and 12B, so that the front ends of the main bodies 21 are inserted therein in a fitted state.

Furthermore, as illustrated in FIGS. 1 and 3, a retainer mounting hole 15 is provided in the housing body 11 so as to be opened from the lower face to both side faces of the housing body 11. The retainer mounting hole 15 has a square shape in cross section, seen from the side (see FIG. 3), and intersects the cavities 12A and 12B at a substantially right angle so as to communicate with the cavities 12A and 12B. The retainer 60 is inserted from below into the retainer mounting hole 15.

Figure 8:
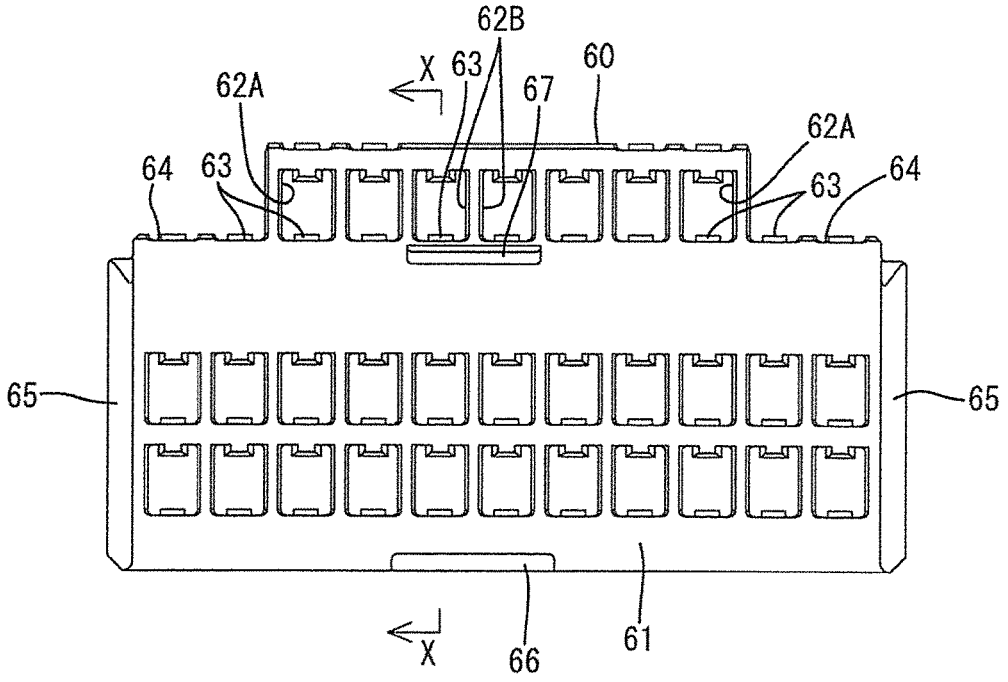
FIG. 8 is a front view of the retainer.
Figure 9:
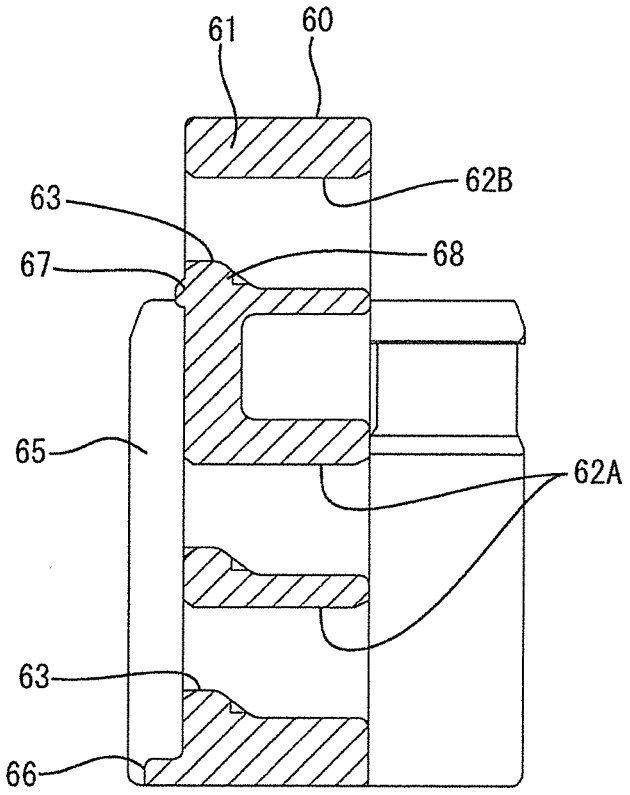
FIG. 9 is a cross-sectional view taken along line X-X in FIG. 8.

The retainer 60 is made of synthetic resin. As illustrated in FIGS. 8 and 9, the retainer 60 has a retainer body 61 having a plate shape along the up-down direction and the width direction. As illustrated in FIG. 3, the retainer body 61 has such a shape and size that the retainer body 61 can be internally fitted into the retainer mounting hole 15. In the retainer body 61, a plurality of through holes 62A and 62B penetrating in the front-back direction are aligned and provided. As illustrated in FIGS. 1 and 3, the through holes 62A and 62B are disposed so as to communicate with the cavities 12A and 12B respectively, in a state where the retainer 60 is properly inserted into the retainer mounting hole 15.

As illustrated in FIGS. 8 and 9, retaining portions 63 are protrudingly provided at the lower edges of the through holes 62A and 62B. As illustrated in FIG. 8, retaining portions 63 are also protrudingly provided in a pair of recessed steps 64 recessed at both widthwise ends of the retainer body 61. As illustrated in FIG. 3, when the retainer 60 is properly inserted into the retainer mounting hole 15, the retaining portions 63 enter the corresponding cavities 12A and 12B from below, and are disposed so as to be engageable with the rear ends of the main bodies 21 of the terminal fittings 20A and the detection terminals 20B respectively, so that the terminal fittings 20A and the detection terminals 20B are secondarily retained in the cavities 12A and 12B respectively.

Furthermore, as illustrated in FIGS. 1 and 8, the retainer body 61 is provided with a pair of protective walls 65 having a plate shape and extending from both widthwise ends of the retainer body 61 to both front and rear sides. As illustrated in FIG. 1, the protective walls 65 are inserted in a fitted state into fitting grooves 16 which are provided so as to be opened in both widthwise end faces of the housing body 11, and close both side openings of the retainer mounting hole 15. In the mounting process of the retainer 60, the protective walls 65 slide on the groove faces of the fitting grooves 16 so that the mounting operation of the retainer 60 is guided.

As illustrated in FIGS. 8 and 9, in the lower end of the front face of the retainer body 61, a stopper 66 having a rib shape along the width direction is protrudingly provided at a position near the center. When the retainer 60 is properly inserted into the retainer mounting hole 15, the stopper 66 abuts onto the lower end of the housing body 11 thereby to prevent the retainer 60 from being pressed in.

Furthermore, as illustrated in FIGS. 8 and 9, on the front face of the retainer body 61, a pressing portion 67 having a rib shape along the width direction is protrudingly provided immediately below the pair of through holes 62B which are located near the center among the through holes 62A and 62B in the upper row. The pressing portion 67 is disposed so as to be across both through holes 62B in substantially parallel with the lower edges of the pair of through holes 62B. As illustrated in FIG. 9, the pressing portion 67 has a substantially trapezoidal shape in cross section protruding above the stopper 66 with a smaller amount of protrusion than the stopper 66.

The lower portion of the pressing portion 67 and the stopper 66 are invisible in side view by being hidden by the protective walls 65, and are substantially covered by both protective walls 65 (see FIG. 9). Accordingly, it can be avoided that foreign substances, not illustrated, from the side, interfere with the pressing portion 67 and the stopper 66, and thus, the pressing portion 67 and the stopper 66 are protected by the protective walls 65. Furthermore, since the protruding end of the pressing portion 67 is located behind the protruding end of the stopper 66, the foreign substances cannot interfere with the pressing portion 67 even when interfering with the stopper 66, and thus, the pressing portion 67 can be protected by the stopper 66.

Figure 5:
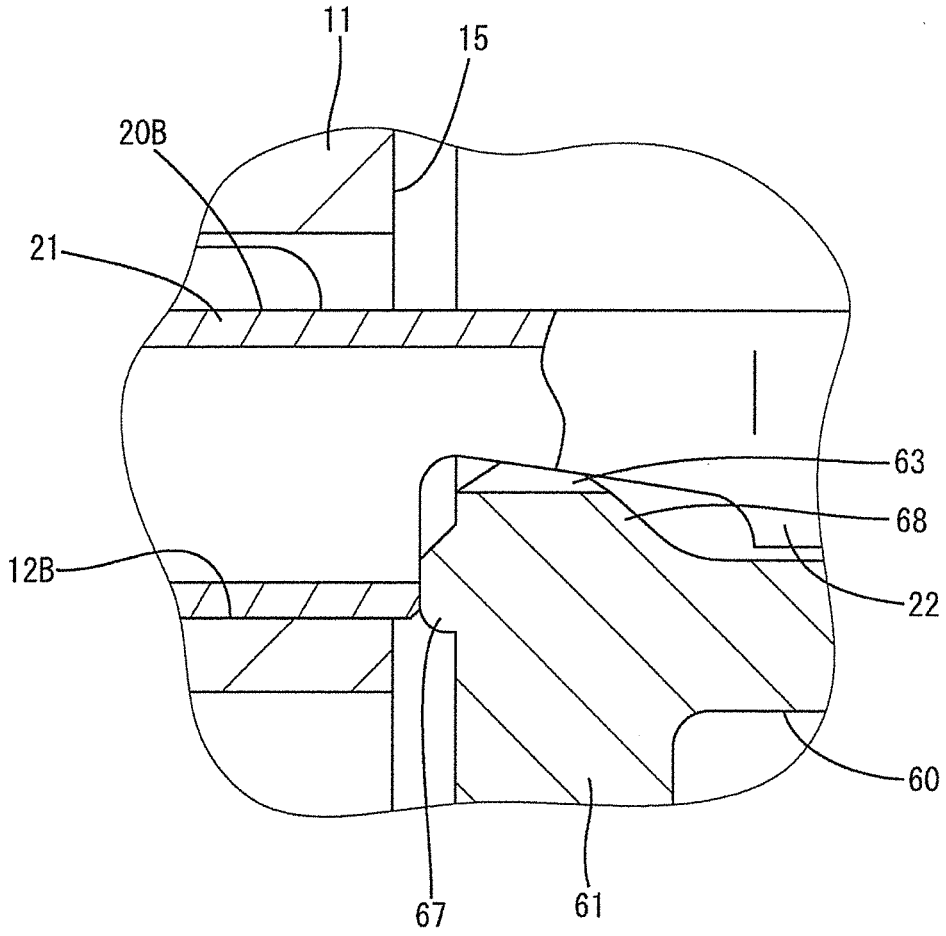
FIG. 5 is an enlarged view of a state where a pressing portion of a retainer abuts onto a detection terminal.

When the retainer 60 is properly inserted into the retainer mounting hole 15, the pair of through holes 62B communicate with both cavities 12B (see FIG. 1), and the pressing portion 67 enters both cavities 12B from below and is disposed therein (see FIG. 3). Then, the pressing portion 67 which has entered both cavities 12B abuts onto the lower edges of the rear ends of the main bodies 21 of the detection terminals 20B, and presses the detection terminals 20B to the front side (the side on which the front wall 51 is located). Thus, as illustrated in FIG. 5, the clearance between the main bodies 21 of the detection terminals 20B and the retainer body 61 is rendered substantially absent. Furthermore, when the detection line 70B connected to the detection terminals 20B is pulled to the rear, the state where the pressing portion 67 abuts onto the main bodies 21 of the detection terminals 20B is maintained, with the result that the detection terminals 20B are prevented from being pulled out to the rear. As illustrated in FIG. 5, the pressing portion 67 is provided in a thick wall 68 together with the retaining portions 63 provided in the through holes 62B, and retains the detection terminals 20B together with the retaining portions 63.

As illustrated in FIG. 8, the pressing portion 67 is not provided at a position corresponding to the cavities 12A into which the terminal fittings 20A are inserted, and only one pressing portion 67 is provided at a position corresponding to the pair of cavities 12B.

Figure 7:
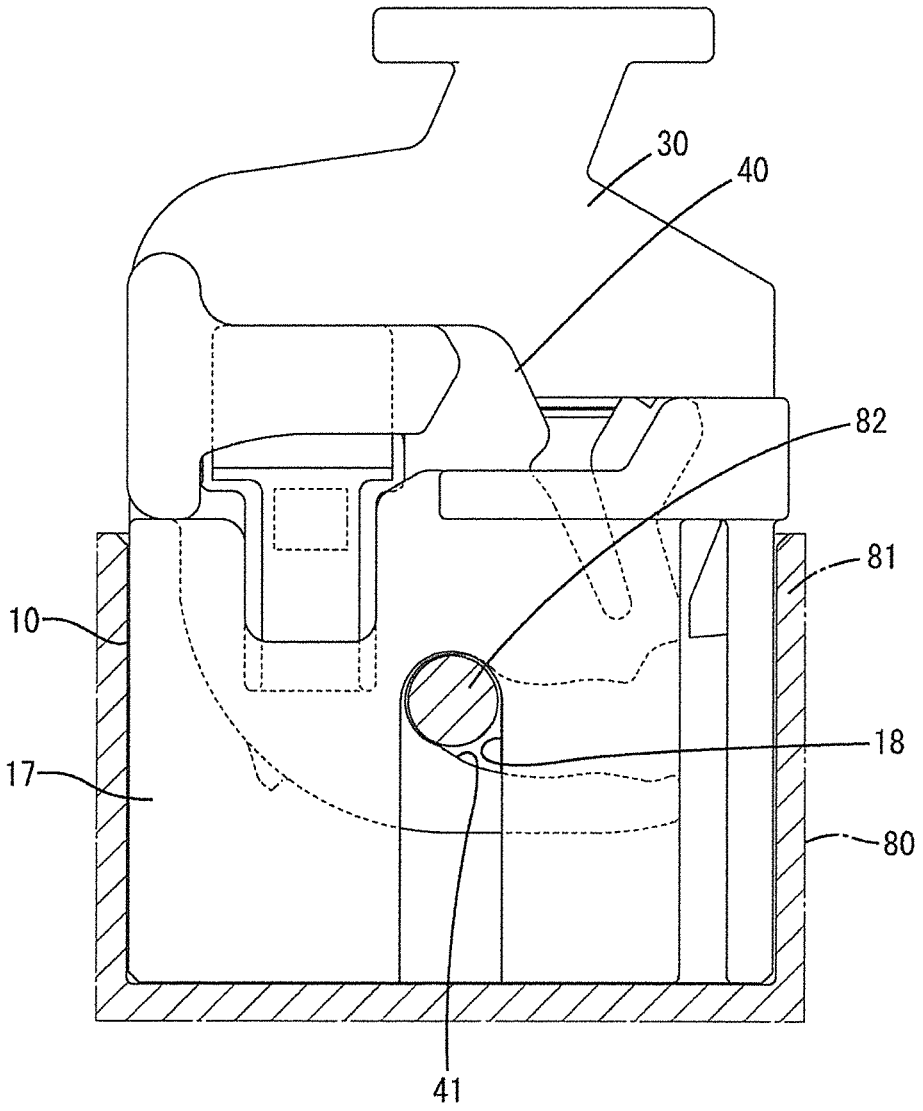
FIG. 7 is a diagram of a state where the housing is properly fitted with the counterpart housing, seen in a plan view.

Furthermore, as illustrated in FIGS. 6 and 7, in the upper end of the housing body 11, a lever accommodating portion 17 is provided above the region in which the cavities 12A and 12B are disposed to be aligned, so as to be opened to the rear. The upper wall of the lever accommodating portion 17 is provided with an introduction groove 18 extending in the front-back direction and opened to the front end of the housing body 11. The lever accommodating portion 17 is configured so that a lever 40 is rotatably accommodated and attached therein. The lever 40 has a plate shape, and has a cam groove 41 extending in a predetermined direction. Furthermore, as illustrated in FIG. 7, an electric wire cover 30 having a cap shape is attached to the rear end of the housing body 11. The signal lines 70A and the detection line 70B are drawn out from the housing body 11, and are drawn out to the outside while being enclosed by the electric wire cover 30.

Next, the assembling procedure and operation of the connector will be described.

Before being assembled into the housing 10, the pair of detection terminals 20B are respectively connected to both ends of the common detection line 70B. Then, the pair of detection terminals 20B are disposed in parallel so that the main bodies 21 are directed to the front while the detection line 70B is turned and bent in a looped shape. Furthermore, the plurality of terminal fittings 20A are respectively connected to the ends of the corresponding signal lines 70A and also disposed so that the main bodies 21 are directed to the front.

Subsequently, the terminal fittings 20A and both detection terminals 20B are inserted into the cavities 12A and 12B of the housing body 11 from the rear respectively, and are primarily retained by the lances 13. At this time, the front ends of the terminal fittings 20A and the front ends of both detection terminals 20B are disposed so as to be aligned at substantially the same position with respect to the front-back direction.

Although not illustrated, before the terminal fittings 20A and both detection terminals 20B are inserted into the cavities 12A and 12B respectively, the retainer 60 is held at the temporary engaging position with respect to the housing 10, and the retaining portions 63 and the pressing portion 67 are disposed so as to be retracted from the corresponding cavities 12A and 12B. Thus, the terminal fittings 20A and both detection terminals 20B are inserted into the cavities 12A and 12B respectively without any trouble without interfering with the retaining portions 63 and the pressing portion 67.

After the terminal fittings 20A and both detection terminals 20B are inserted into the cavities 12A and 12B respectively, the retainer 60 is pressed in upward. In the insertion process of the retainer 60, since the pressing portion 67 slides on the inner face of the retainer mounting hole 15, there is a possibility that sliding resistance could occur. However, since the pressing portion 67 is provided only in the minimum necessary range corresponding to both detection terminals 20B, the sliding resistance is not particularly excessive.

When the retainer 60 is held at the final engaging position with respect to the housing 10 and is properly inserted into the retainer mounting hole 15, the pressing portion 67 abuts onto the lower edges of the rear ends of the main bodies 21 of both detection terminals 20B to press both detection terminals 20B to the front, and the main bodies 21 of both detection terminals 20B are disposed between the front wall 51 and the pressing portion 67 in a state where free movement in the front-back direction is substantially prevented (see FIG. 3). On the other hand, behind the main bodies 21 of the terminal fittings 20A and both detection terminals 20B, the corresponding retaining portions 63 are disposed opposite to the main bodies 21 with small gaps therebetween so as to be engageable with the main bodies 21.

As illustrated in FIG. 2(B), when the detection terminals 20B are inserted into the cavities 12B, the detection line 70B is disposed so as to spread in a predetermined range behind the housing body 11 in a turned and bent state in a looped shape. Due to this, the signal lines 70A located on both sides of the detection line 70B having a looped shape are also spread by being pressed by the detection line 70B, so that the space efficiency of the electric wire routing could be deteriorated. In view of this, in this example, as illustrated in FIG. 1, the detection line 70B projecting to the rear of the housing body 11 is narrowed to a small width together with the signal lines 70A, and in that state, a tape 35 as a bundling member is wound around the detection line 70B and the signal lines 70A, so that the detection line 70B and the signal lines 70A are compactly held and bundled together. In particular, in the illustrated case, in order to reliably prevent the spread of the detection line 70B, a folded portion 75 of the detection line 70B is covered by the tape 35 and fixed so as to cohere inside of the tape 35.

Subsequently, the housing 10 is fitted into the hood 81 of the counterpart housing 80. When both of the housings 10 and 80 are shallowly fitted, the cam follower 82 of the counterpart housing 80 enters the inlet of the cam groove 41 of the lever 40 through the introduction groove 18 of the housing body 11. When the lever 40 is rotated in that state, the cam follower 82 slides on the groove face of the cam groove 41 to exhibit the cam operation, so that both of the housings 10 and 80 are mutually fitted by a low fitting force. As illustrated in FIG. 7, when both of the housings 10 and 80 are properly fitted, the cam follower 82 reaches the inner side of the cam groove 41, so that both of the housings 10 and 80 are held in a state of being prevented from being removed from each other.

Now, in the final fitting stage of both of the housings 10 and 80, as illustrated in FIG. 3, the tabs 91A of the counterpart terminal fittings 90A are inserted into the main bodies 21 of the terminal fittings 20A through the tab insertion holes 52, and thereafter, the tabs 91B of the counterpart detection terminals 90B are inserted into the main bodies 21 of the detection terminals 20B through the tab insertion holes 52. At this time, the tabs 91A of the counterpart terminal fittings 90A come into contact with the elastic contact pieces 24 in the main bodies 21 of the terminal fittings 20A and are conductively connected, but the tabs 91B of the counterpart detection terminals 90B have not yet reached the position where the tabs 91B come into contact with the elastic contact pieces 24 in the main bodies 21 of the detection terminals 20B. Thus, the detection circuit remains opened at this stage.

Figure 4:
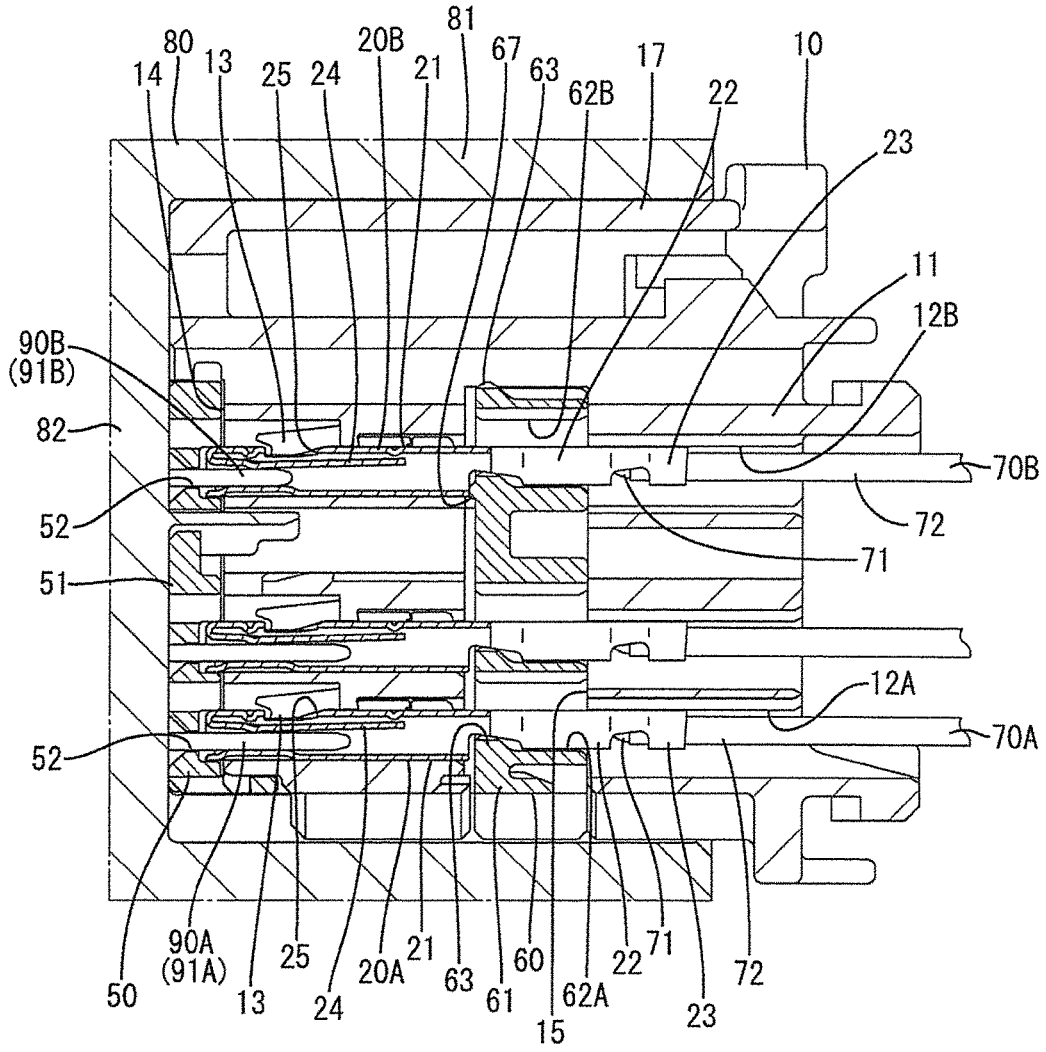
FIG. 4 is a diagram of a state where the tabs have been inserted into the main bodies to the proper depth when both of the housings are properly fitted together, seen in side view.

Thereafter, as illustrated in FIG. 4, when both of the housings 10 and 80 are properly fitted, the tabs 91A of the counterpart terminal fittings 90A are inserted to the proper depth into the main bodies 21 of the terminal fittings 20A and maintain the contact state with the elastic contact pieces 24, and the tabs 91B of the counterpart detection terminals 90B come into contact with the elastic contact pieces 24 and are conductively connected. As a result, the detection circuit is closed, and it becomes possible to electrically detect that both of the housings 10 and 80 are properly fitted.

As described above, according to this example, the pair of detection terminals 20B are mutually connected via the detection line 70B, and the detection terminals 20B are formed in the same shape as the terminal fittings 20A. Thus, the terminal fittings 20A and the detection terminals 20B can be formed in the same process, so that the number of processes and the die cost can be reduced.

Furthermore, although the detection line 70B connected to the pair of detection terminals 20B has a looped shape, the detection line 70B having a looped shape and the signal lines 70A are fixed together by being wound by the tape 35. Thus, worsening of the space efficiency can be avoided.

Furthermore, the tabs 91B of the counterpart detection terminals 90B are shorter than the tabs 91A of the counterpart terminal fittings 90A, and the timing at which the counterpart terminal fittings 90A are inserted and connected into the main bodies 21 is set to be earlier than the timing at which the counterpart detection terminals 90B are inserted and connected into the main bodies 21. Thus, the proper fitting state of both of the housings 10 and 80 can be detected after the terminal fittings 20A and the counterpart terminal fittings 90A are electrically connected, so that the reliability of the fitting detection can be enhanced.

Furthermore, after the detection terminals 20B are inserted into the cavities 12B, the retainer 60 is properly inserted into the retainer mounting hole 15 so that the detection terminals 20B are pressed to the front wall 51 side by the pressing portion 67, with the result that the clearance between the retainer 60 and the detection terminals 20B is reduced or rendered substantially absent. Thus, the detection terminals 20B do not move freely in the cavities 12B greatly, so that the detection reliability can be improved.

Furthermore, since the pressing portion 67 is not provided at the position corresponding to the terminal fittings 20A, the configuration of the retainer 60 is simplified, and the sliding resistance between the pressing portion 67 and the housing body 11 does not become large in the mounting process of the retainer 60. Thus, worsening of the mounting operability of the retainer 60 can be avoided.

OTHER EXAMPLES

Other examples will be briefly described below.

(1) When a plurality types of terminal fittings having different shapes and sizes are accommodated in the housing, at least one type of the terminal fittings and detection terminals should be formed in the same shape.

(2) The terminal fittings and the detection terminals may be male terminal fittings in which the tabs protrude to the front of the main body portions having a tubular shape.

(3) In the above example, the front wall is provided in the front holder separate from the housing body, but according to the present invention, the front wall may be provided integrally with the housing body.

(4) The pressing portion may be individually disposed at the position corresponding to each of the pair of detection terminals.

(5) The entire pressing portion may be covered by the protective walls so as to be invisible in side view by being hidden by the protective walls.

(6) When the detection terminals are deeply inserted into the cavities and are located ahead of the predetermined positions, the pressing portion may not abut onto the main bodies of the detection terminals when the retainer is properly inserted into the retainer mounting hole.

(7) The bundling member to bundle the detection line and the signal lines is not particularly limited, and in place of the tape, for example, a tie band may be used.

REFERENCE SIGNS LIST

10 . . . housing
12A . . . cavity (into which a terminal fitting is inserted)
12B . . . cavity (into which a detection terminal is inserted)
15 . . . retainer mounting hole
20A . . . terminal fitting
20B . . . detection terminal
21 . . . main body
35 . . . tape (bundling member)
51 . . . front wall
60 . . . retainer
65 . . . protective wall
67 . . . pressing portion
70A . . . signal line (electric wire for signal)
70B . . . detection line (electric wire for detection)
90A . . . counterpart terminal fitting
90B . . . counterpart detection terminal
91A . . . tab (of a counterpart terminal fitting)
91B . . . tab (of a counterpart detection terminal)

The invention claimed is:

1. A connector comprising:

a housing configured to be fit with a counterpart housing;

one or more terminal fittings provided in the housing, the one or more terminal fittings being connected respectively to ends of one or more electric wires and being configured respectively for electrically contacting one or more counterpart terminal fittings provided in the counterpart housing when the housing and the counterpart housing are fit together; and two detection terminals provided in the housing and configured to be mutually energized and thereby to form a detection circuit when the housing and the counterpart housing are fit properly together, the two detection terminals being mutually connected via an electric wire and being formed in the same shape as the one or more terminal fittings, wherein the housing is provided with cavities into which the one or more terminal fittings and the detection terminals are inserted respectively, a front wall closing a space on a front side of each of the cavities in an insertion direction of the one or more terminal fittings and the detection terminals, and a retainer mounting hole intersecting and communicating with the cavities;

a retainer inserted into the retainer mounting hole and configured to retain the one or more terminal fittings and the detection terminals;

a pressing portion protruding on the retainer and capable of abutting onto the detection terminals and pressing the detection terminals toward the front wall; and the pressing portion is not disposed at a position corresponding to the one or more terminal fittings.

2. The connector according to claim 1, wherein the electric wire connected to the detection terminals is bundled together with the one or more electric wires connected to the one or more terminal fittings by a bundling member.

3. The connector according to claim 2, wherein the retainer is provided with a stopper configured to abut onto the housing when the retainer is properly inserted into the housing, the stopper and the pressing portion mutually protrude in the same direction, and a protruding end of the pressing portion is located behind a protruding end of the stopper.

4. The connector according to claim 3, wherein the counterpart housing is provided with counterpart detection terminals electrically connected to the detection circuit, the counterpart detection terminals and the counterpart terminal fittings are male terminals having respective tabs, the detection terminals and the terminal fittings are female terminals having respective main bodies into which the tabs are each inserted and connected, and the tabs of the counterpart detection terminals are shorter than the tabs of the counterpart terminal fittings.

5. The connector according to claim 1, wherein the retainer is provided with a stopper configured to abut onto the housing when the retainer is properly inserted into the housing, the stopper and the pressing portion mutually protrude in the same direction, and a protruding end of the pressing portion is located behind a protruding end of the stopper.

6. The connector according to claim 5, wherein the counterpart housing is provided with counterpart detection terminals electrically connected to the detection circuit, the counterpart detection terminals and the counterpart terminal fittings are male terminals having respective tabs, the detection terminals and the terminal fittings are female terminals having respective main bodies into which the tabs are each inserted and connected, and the tabs of the counterpart detection terminals are shorter than the tabs of the counterpart terminal fittings.

7. The connector according to claim 1, wherein the counterpart housing is provided with counterpart detection terminals electrically connected to the detection circuit, the counterpart detection terminals and the counterpart terminal fittings are male terminals having respective tabs, the detection terminals and the terminal fittings are female terminals having respective main bodies into which the tabs are each inserted and connected, and the tabs of the counterpart detection terminals are shorter than the tabs of the counterpart terminal fittings.

* * * * *